US009601069B2

(12) United States Patent
Cho et al.

(10) Patent No.: US 9,601,069 B2
(45) Date of Patent: Mar. 21, 2017

(54) METHOD OF DRIVING A DISPLAY PANEL AND A DISPLAY APPARATUS PERFORMING THE METHOD

(71) Applicant: SAMSUNG DISPLAY CO., LTD., Yongin, Gyeonggi-Do (KR)

(72) Inventors: Eui-Myeong Cho, Anyang-si (KR); Ki-Hyun Pyun, Goyang-si (KR); Eun-Kyung Kim, Asan-si (KR); Hee-Jeong Seo, Asan-si (KR); Jong-Young Yun, Gwangmyeong-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 363 days.

(21) Appl. No.: 14/166,408

(22) Filed: Jan. 28, 2014

(65) Prior Publication Data

US 2015/0054818 A1 Feb. 26, 2015

(30) Foreign Application Priority Data

Aug. 23, 2013 (KR) ..... 10-2013-0100346

(51) Int. Cl.

*G09G 3/36* (2006.01)
*G09G 3/20* (2006.01)
*G09G 3/34* (2006.01)

(52) U.S. Cl.

CPC ..... *G09G 3/3648* (2013.01); *G09G 3/2096* (2013.01); *G09G 3/3426* (2013.01); *G09G 3/3674* (2013.01); *G09G 2230/00* (2013.01); *G09G 2310/0202* (2013.01); *G09G 2310/024* (2013.01); *G09G 2310/0267* (2013.01); *G09G 2310/0275* (2013.01)

(58) Field of Classification Search

CPC ..... G09G 3/3614; G09G 3/3659; G09G 2310/0202; G09G 2310/0278; G09G 2320/0233

USPC ..... 345/87–100, 204

See application file for complete search history.

(56) References Cited

U.S. PATENT DOCUMENTS

| | | | | |
|---|---|---|---|---|
| 6,545,655 | B1 * | 4/2003 | Fujikawa | G09G 3/3611 345/103 |
| 7,484,854 | B2 | 2/2009 | Miyasaka | |
| 2007/0171175 | A1 * | 7/2007 | Chiang | G09G 3/3648 345/100 |
| 2015/0138176 | A1 * | 5/2015 | Yokonuma | G09G 3/3648 345/209 |

FOREIGN PATENT DOCUMENTS

| | | |
|---|---|---|
| JP | 2003-122316 | 4/2003 |
| KR | 1020070006281 | 1/2007 |
| KR | 1020080047881 | 5/2008 |
| KR | 1020080096907 | 11/2008 |
| KR | 1020110138006 | 12/2011 |

* cited by examiner

*Primary Examiner* — Jennifer Nguyen

(74) *Attorney, Agent, or Firm* — F. Chau & Associates, LLC.

(57) ABSTRACT

A method of driving a display panel is provided. The method includes displaying a first image on at least one odd-numbered horizontal line of the display panel along a first direction and a second direction during a first period of a frame period and displaying a second image on at least one even-numbered horizontal line of the display panel along the first direction and second direction during a second period of the frame period.

21 Claims, 9 Drawing Sheets

METHOD OF DRIVING A DISPLAY PANEL AND A DISPLAY APPARATUS PERFORMING THE METHOD

CROSS-REFERENCE TO RELATED PATENT APPLICATION

This application claims priority under 35 U.S.C. §119 to Korean Patent Application No. 10-2013-0100346, filed on Aug. 23, 2013, in the Korean Intellectual Property Office, the disclosure of which is incorporated by reference herein in its entirety.

TECHNICAL FIELD

The present invention relates to a display method and a display apparatus, and more particularly, to a method of driving a display panel and a display apparatus performing the method.

DISCUSSION OF THE RELATED ART

Generally, a liquid crystal display (LCD) apparatus includes an LCD panel that displays images using a light transmittance of a liquid crystal and a backlight assembly that provides light to the LCD panel.

The LCD panel includes a plurality of gate lines, a plurality of data lines, a plurality of pixels, a gate driving circuit which outputs gate signals to the gate lines, and a data driving circuit which outputs data signals to the data lines. Each of the pixels includes a liquid crystal capacitor and a thin film transistor. The thin film transistor is connected to the data lines, the gate lines, and the liquid crystal capacitor and drives the liquid crystal capacitor. The thin film transistor provides the liquid crystal capacitor with the data signal transferred through the data line, in response to the gate signal transferred through the gate line.

Therefore, the liquid crystal capacitor charges a data signal corresponding to a grayscale of an image. For example, when an LCD panel is in a black mode, both ends of the liquid crystal capacitor in the pixel may have a maximum potential difference such that the pixel displays a white grayscale, or may have a minimum potential difference such that the pixel displays a black grayscale.

SUMMARY

According to an exemplary embodiment of the present invention, a method of driving a display panel is provided. The method includes displaying a first image on at least one odd-numbered horizontal line of the display panel along a first direction and a second direction during a first period of a frame period and displaying a second image on at least one even-numbered horizontal line of the display panel along the first direction and the second direction during a second period of the frame period.

In an exemplary embodiment, the method may further include generating a first vertical start signal, a second vertical start signal, a first clock signal, and a second clock signal in response to a horizontal pattern image. The first vertical start signal may be a control signal for the forward direction control signal and the second vertical start signal may be a control signal for the second direction.

In an exemplary embodiment, the first clock signal may be generated during the first period and not generated during the second period. The second clock signal may be generated during the second period and not generated during the first period.

In an exemplary embodiment, the method may further include outputting a first gate signal and a second gate signal in response to the first clock signal during the first period and outputting a third gate signal and a fourth gate signal in response to the second clock signal during the second period. The first gate signal and the second gate signal may correspond to a first odd-numbered horizontal line and a last odd-numbered horizontal line, respectively. The third gate signal and the fourth gate signal may correspond to a first even-numbered horizontal line and a last even-numbered horizontal line, respectively.

In an exemplary embodiment, the method may further include outputting a first data signal of the first image to a corresponding one of a plurality of data lines of the display panel during the first period and outputting a second data signal of the second image to a corresponding one of the plurality of data lines of the display panel during the second period.

In an exemplary embodiment, the first period may be a first half period of the frame period and the second period may be a second half period of the frame period.

In an exemplary embodiment, the first and second images may be a white image and a black image, respectively.

According to an exemplary embodiment of the invention, a display apparatus is provided. The display apparatus includes a display panel and a panel driving part. The display panel includes a plurality of horizontal lines. the panel driving part is configured to display a first image on at least one odd-numbered horizontal line of the display panel along a first direction and a second direction during an first part period of a frame period and to display a second image on at least one even-numbered horizontal line of the display panel along the first direction and the second direction during a second part of the frame period.

In an exemplary embodiment, the panel driving part may include a timing control part and a gate driving part. The timing control part may be configured to generate a first vertical start signal, a second vertical start signal, a first clock signal, and a second clock signal. The gate driving part may be configured to output first to n-th gate signals to first to n-th gate lines of the display panel, respectively. The first vertical start signal may control the gate driving part to sequentially output the first to n-th gate signals in the first direction. The second vertical start signal may control the gate driving part to sequentially output the first to n-th gate signals in the second direction. The first clock signal may control at least one odd-numbered gate signal, and the second clock signal may control at least one even-numbered gate signal.

In an exemplary embodiment, the timing control part may control each output of the first and second clock signals based on a pattern of the image.

In an exemplary embodiment, the pattern of the image may be a horizontal pattern.

In an exemplary embodiment, the timing control part may provide the gate driving part with the first clock signal and might not provide the gate driving part with the second clock signal during the first part of the frame period. The timing control part may provide the gate driving part with the second clock signal and might not provide the gate driving part with the first clock signal during the second part of the frame period.

In an exemplary embodiment, the timing control part may include a clock generating part and a switching part. The clock generating part may be configured to generate the first and second clock signals. The switching part may be configured to control the output of the first and second clock signals.

In an exemplary embodiment, the switching part may output the first clock signal and might not output the second clock signal during the first part of the frame period, and the switching part may output the second clock signal and might not output the first clock signal during the second part of the frame period.

In an exemplary embodiment, the timing control part may concurrently output the first and second vertical start signals to the gate driving part.

In an exemplary embodiment, the panel driving part may output a data signal of a white image to the display panel during the first part of the frame period, and may output a data signal of a black image to the display panel during the second part of the frame period.

In an exemplary embodiment, the first clock signal may have a phase opposite to the second clock signal. Each of the first and second clock signals may be a periodic pulse signal having a predetermined period.

In an exemplary embodiment, the predetermined period may be two horizontal periods.

In an exemplary embodiment, the gate driving part may include first to n-th shift registers. Each of the first to n-th shift registers may output the first to n-th gate signals to the first to n-th gate lines of the display panel.

In an exemplary embodiment, the first vertical start signal may be applied to the first shift register and the second vertical start signal may be applied to the n-th shift register.

In an exemplary embodiment, the first clock signal may control at least one odd-numbered shift register and the second clock signal may control at least one even-numbered shift register.

According to an exemplary embodiment of the present invention, a timing control unit is provided. The timing control unit includes a control part, a clock generating part, and a switching part. The timing control unit is configured to output a first switching signal and a second switching signal to a gate driving part of a display apparatus. The clock generating part is configured to generate a first clock signal and a second clock signal. The switching part is configured to control an output of the first clock signal and the second clock signal based on the first switching signal and the second switching signal, respectively. The output of the first clock signal is applied to the gate driving part and the output of the second clock signal is not applied to the gate driving part during a first part of a frame period. The output of the second clock signal is applied to the gate driving part and the first clock signal is not applied to the gate driving part during a second part of the frame period.

In an exemplary embodiment, the control part may control the gate driving part to output at least one odd-numbered gate signal in a first direction and a second direction during the first part of the frame period. The control part control part may control the gate driving part to output at least one even-numbered gate signal in the first direction and the second direction during the second part of the frame period. The first vertical start signal may be a control signal for the first direction and the second vertical start signal may be a control for the second direction.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EMBODIMENTS

Hereinafter, exemplary embodiments of the present invention will be explained in detail with reference to the accompanying drawings.

Figure 1:
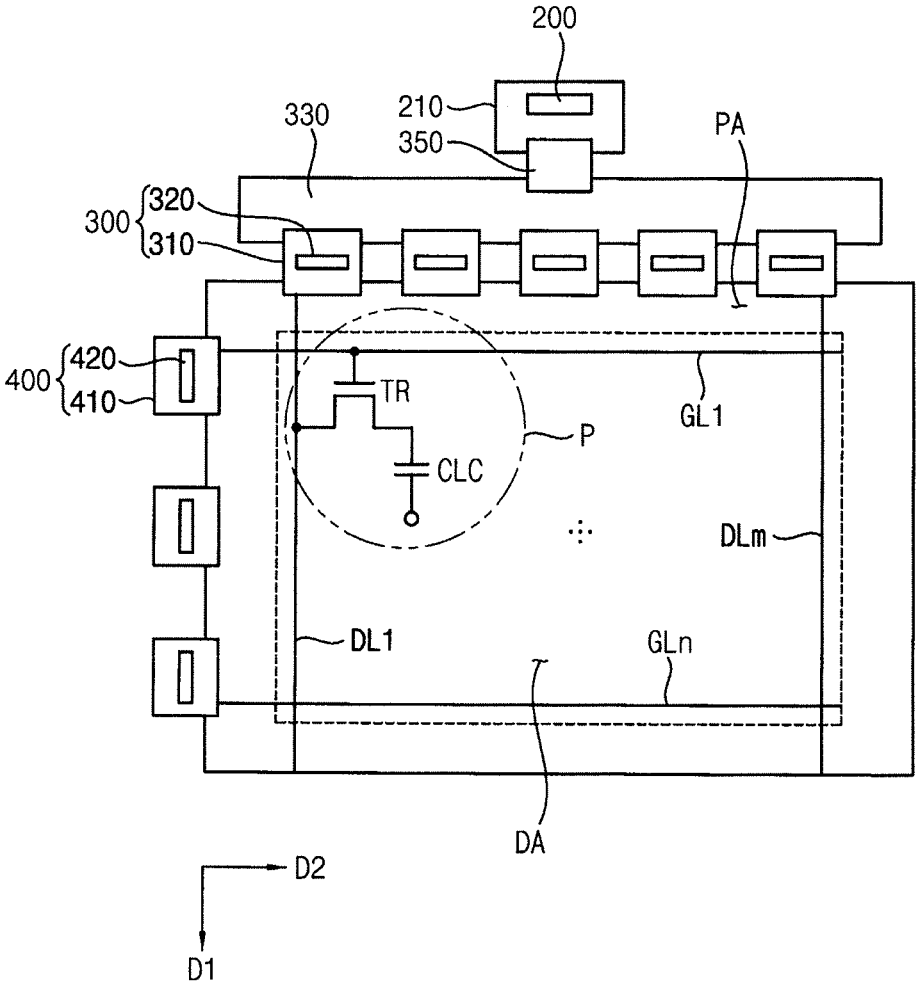
FIG. 1 is a block diagram illustrating a display apparatus according to an exemplary embodiment of the present invention.
Figure 2:
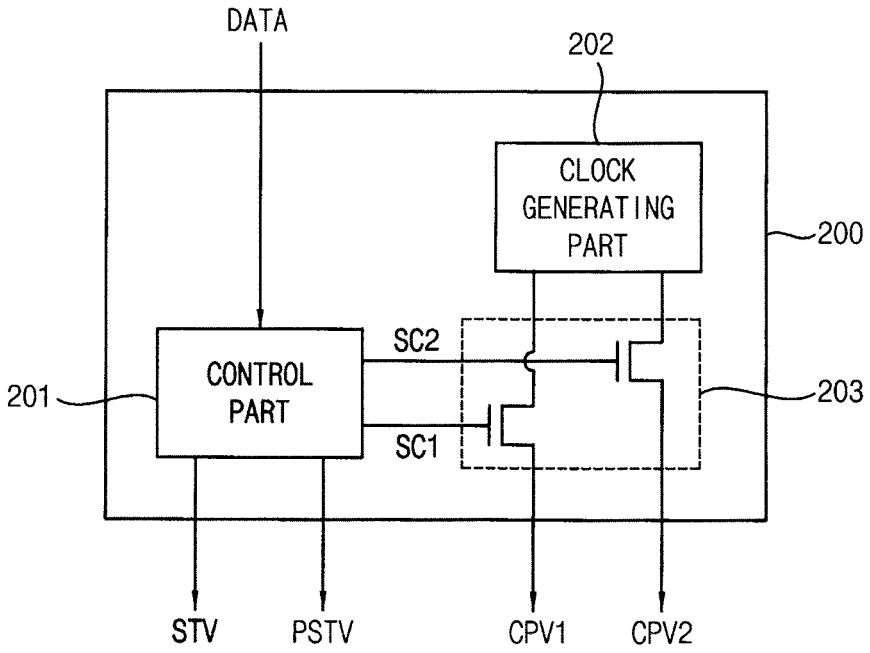
FIG. 2 is a block diagram illustrating a timing control part of a display apparatus shown in FIG. 1, according to an exemplary embodiment of the present invention.

FIG. 1 is a block diagram illustrating a display apparatus according to an exemplary embodiment of the present invention. FIG. 2 is a block diagram illustrating a timing control part of the display apparatus shown in FIG. 1, according to an exemplary embodiment of the present invention.

Referring to FIGS. 1 and 2, the display apparatus may include a display panel 100 and a panel driving part.

The display panel 100 may include a display area DA and a peripheral area PA that surrounds the display area DA. A plurality of data lines DL1, . . . , DLm, a plurality of gate lines GL1, . . . , GLn, and a plurality of pixels P are disposed in the display area DA. The data lines DL1, . . . , DLm extend in a first direction D1 and are arranged in a second direction D2 that crosses the first direction D1. The gate lines GL1, . . . , GLn extend in the second direction D2 and are arranged in the first direction D1. The pixels P are arranged in a matrix form. The pixels P include a plurality of column pixels arranged in the first direction D1 and a plurality of row pixels arranged in the second direction D2. Each of the pixels P may include a thin film transistor TR and a liquid crystal capacitor CLC. The thin film transistor TR may be connected to a data line DL1, a gate line GL1, and the liquid crystal capacitor CLC.

The panel driving part may be disposed in the peripheral area PA.

The panel driving part may include a timing control part 200, a data driving part 300, and a gate driving part 400.

The timing control part 200 is disposed on a control printed circuit board 210. The timing control part 200 controls operations of the data driving part 300 and the gate driving part 400. For example, the timing control part 200 may generate a data control signal to control the data driving part 300. The data control signal may include a horizontal synchronization signal, a vertical synchronization signal, a load signal, etc. The timing control part 200 receives an image data and corrects the image data using various compensation algorithms for decreasing a response time and reproducing a color, and then the corrected image data is applied to the data driving part 300.

Referring to FIG. 2, the timing control part 200 generates a gate control signal to control the gate driving part 400. The gate control signal may include a first vertical start signal STV, a second vertical start signal PSTV, a first clock signal CPV1, and a second clock signal CVP2. The timing control part 200 may include a control part 201, a clock generating part 202, and a switching part 203.

The control part 201 generates a first vertical start signal STV, a second vertical start signal PSTV, a first switching signal SC1, and a second switching signal SC2. The first and second vertical start signals STV and PSTV control an output sequence of a plurality of gate signals outputted from the gate driving part 400. For example, the first vertical start signal STV is a forward direction control signal which controls the gate driving part 400 to output the gate signals in order from a first gate signal to an n-th gate signal. Here, the first to n-th gate signals correspond to the signals applied to first to n-th gate lines, respectively. The second vertical start signal PSTV is a reverse direction control signal which controls the gate driving part 400 to output the gate signals in order from the n-th gate signal to the first gate signal. The first switching signal SC1 controls an output of the first clock signal CPV1 generated from the clock generating part 202. The second switching signal SC2 controls an output of the second clock signal CPV2 generated from the clock generating part 202.

The clock generating part 202 generates the first clock signal CPV1 and the second clock signal CVP2. The first clock signal CPV1 may be an alternating signal having a predetermined period. The second clock signal CPV2 is an alternating signal having an opposite phase to the first clock signal CPV1. For example, the predetermined period may be two horizontal periods (2H). Here, the horizontal period (H) may be a time interval in which each horizontal line of the display panel 100 is displayed.

The switching part 203 controls each output of the first and second clock signals CPV1 and CPV2 based on the first and second switching signals SC1 and SC2, respectively. When the first switching signal SC1 is at a high level, the first clock signal CPV1 may be outputted. When the first switching signal SC1 is at a low level, the first clock signal CPV1 might not be outputted. Further, when the second switching signal SC2 is at a high level, the second clock signal CPV2 may be outputted. When the second switching signal SC2 is at a low level, the second clock signal CPV2 might not be outputted.

According to an exemplary embodiment of the present invention, the control part 201 receives image data DATA and outputs the first and second clock signals CPV1 and CPV2 based on the image data DATA. When the image data DATA corresponds to a normal image, the control part 201 may control the first and second switching signals SC1 and SC2 to have the high level. In other words, the first and second clock signals CPV1 and CPV2 having the high level may be applied to the gate driving part 400 when the normal image data DATA is inputted.

However, when the image data DATA corresponds to an image having a pattern (e.g., a horizontal stripe pattern image), the control part 201 controls levels of the first and second switching signals SC1 and SC2 in a separate or in a different manner for an early ½ period of a frame period (hereafter, referred to as "early ½ frame period") and a late ½ period of the frame period (hereafter, referred to as "late ½ frame period"). During the early ½ frame period, the timing control part 201 controls one of the first and second switching signals SC1 and SC2 to have the high level and the other one of the first and second switching signals SC1 and SC2 to have the low level. During the late ½ frame period, the timing control part 201 controls the levels of the first and second switching signals SC1 and SC2 to be opposite to the levels of the first and second switching signals SC1 and SC2 for the early ½ frame period. For example, during the early ½ frame period, the first switching signal SC1 has the high level and the second switching signal SC2 has the low level. During the late ½ frame period, the second switching signal SC2 may have the high level and the first switching signal SC1 may have the low level.

Therefore, during the early ½ frame period, the first clock signal CPV1 may be applied to the gate driving part 400 and the second clock signal CPV2 might not be applied to the gate driving part 400. During the late ½ frame period, the second clock signal CPV2 may be applied to the gate driving part 400 and the first clock signal CPV1 might not be applied to the gate driving part 400.

The horizontal stripe pattern image may include a black image and a white image which are alternately arranged by one horizontal line of the display panel 100. The horizontal stripe pattern image may be a test image used in a visual test process of a display panel.

According to a normal operation of the data driving part, the data driving part 300 may alternately output data voltages that correspond to a white grayscale and a black grayscale to the display panel 100 by one horizontal line of the display panel 100. Thus, an operating frequency of the data driving part 300 may be increased so that a surface temperature of the data driving part 300 may be more than about 125° C.

According to an exemplary embodiment of the present invention, in comparison to the normal operation of the data driving part 300, when the horizontal stripe pattern image is displayed on the display panel 100, the timing control part 200 may control the output sequence of the gate signals outputted from the gate driving part 400 through the gate control signal. Thus, an operating frequency of the data driving part 300 may be decreased and a surface temperature of the data driving part 300 may be decreased. A method of displaying the horizontal stripe pattern image according to an exemplary embodiment of the present invention will be described later.

The data driving part 300 may include a data flexible circuit board 310 and a data driving chip 320. The data driving chip 320 may be disposed on the data flexible circuit board 310. The data driving part 300 is connected to the timing control part 200 through a source printed circuit board 330 and a flexible circuit film 350. The data driving part 300 converts the data signal to a data voltage and outputs the data voltage to the data line based on the data control signal received from the timing control part 200.

The gate driving part 400 may include a gate flexible circuit board 410 and a gate driving chip 420. The gate driving chip 420 may be disposed on the gate flexible circuit board 410. The gate driving chip 420 receives the gate control signal from the timing control part 200 through the data flexible circuit board 310. The gate driving part 400 generates a plurality of gate signals and outputs the gate signals to the gate lines based on the gate control signal.

Although not shown in figures, the gate driving part 400 may be directly formed in the peripheral area PA of the display panel 100. For example, the gate driving part 400 may be formed in the peripheral area PA of the display panel 100 using substantially the same process as that used for the thin film transistor TR to be formed.

Figure 3:
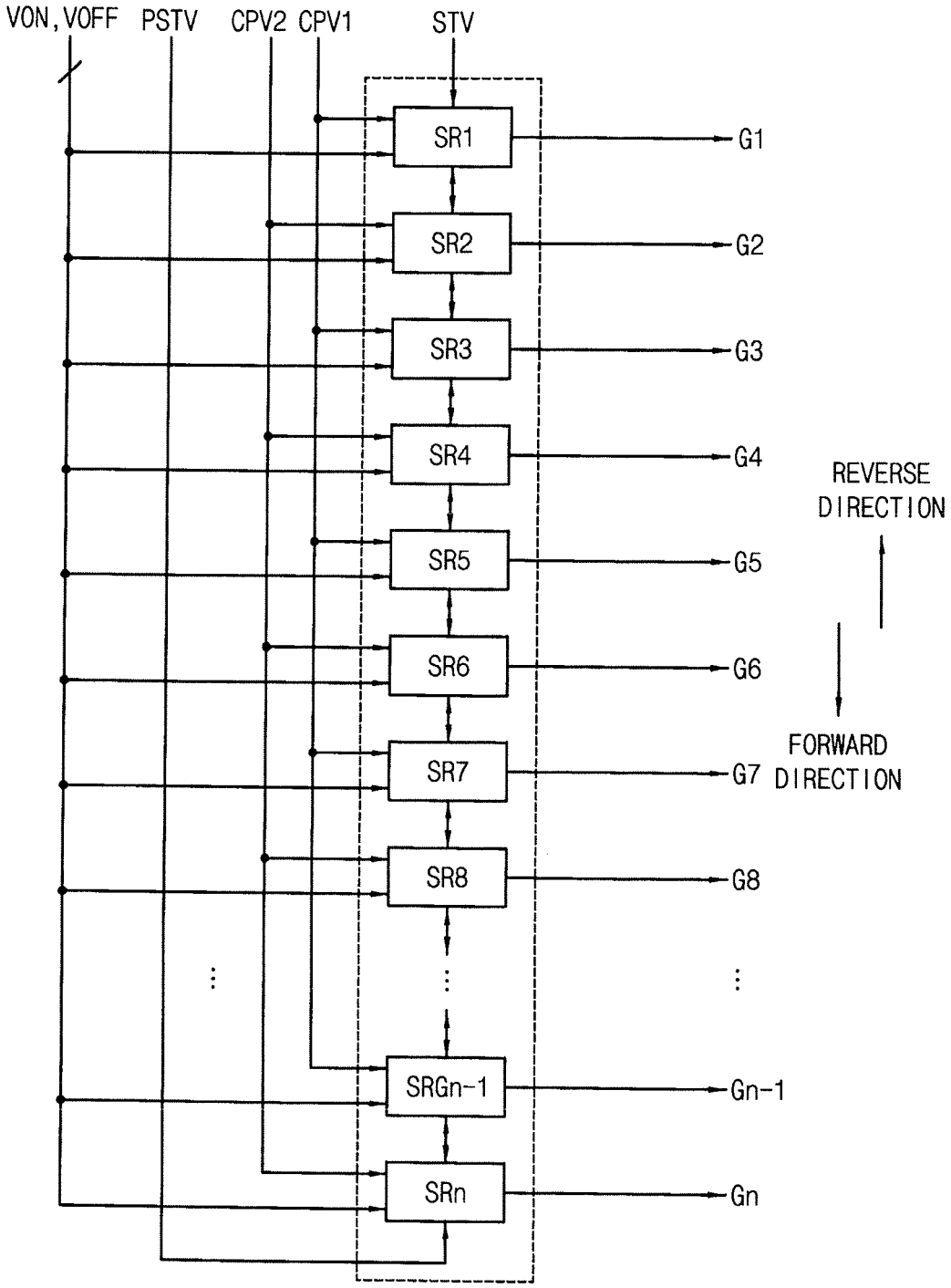
FIG. 3 is a block diagram illustrating a gate driving part of a display apparatus shown in FIG. 1, according to an exemplary embodiment of the present invention.

FIG. 3 is a block diagram illustrating a gate driving part shown in FIG. 1, according to an exemplary embodiment of the present invention.

Referring to FIGS. 1 to 3, the gate driving part 400 may include a plurality of shift registers SR1, SR2, . . . , SRn. The shift registers SR1, SR2, . . . , SRn output first to n-th gate signals G1, . . . , Gn to first to n-th gate lines GL1, . . . , GLn.

The gate driving part 400 receives the first vertical start signal STV, the second vertical start signal PSTV, the first clock signal CPV1, the second clock signal CPV2, a gate on signal VON, and a gate off signal VOFF from the timing control part 200.

The first vertical start signal STV is a forward direction control signal and is applied to the first shift register SR1 which outputs the first gate signal G1. The gate driving part 400 may start to sequentially output the first to n-th gate signals G1, G2, . . . , Gn in the forward direction in response to the first vertical start signal STV. The second vertical start signal PSTV is a reverse direction control signal and is applied the n-th shift register SRn which is the last shift register and outputs the last gate signal Gn. The gate driving part 400 starts to sequentially output the n-th to the first gate signals Gn, Gn-1, . . . , G1 in the reverse direction in response to the second vertical start signal PSTV.

The first clock signal CPV1 may be applied to the odd-numbered shift registers SR1, SR3, . . . , Sn-1 and thus, the odd-numbered shift registers SR1, SR3, . . . , Sn-1 may output the odd-numbered gate signals G1, G3, . . . , Gn-1 in synchronization with each clock pulse of the first clock signal CPV1. The second clock signal CPV2 may be applied to even-numbered shift registers SR2, SR4, . . . , SRn and thus, the even-numbered shift registers SR2, SR4, . . . , SRn may output even-numbered gate signals G2, G4, . . . , Gn in synchronization with each clock pulse of the second clock signal CPV2.

When the display panel 100 displays the normal image, the gate driving part 400 may receive one of the first vertical start signal STV and the second vertical start signal PSTV, the first clock signal CPV1, and the second clock signal CPV2. For example, when the gate driving part 400 is driven in the forward direction mode, the gate driving part 400 may receive the first vertical start signal STV. When the gate driving part 400 is driven in the reverse direction mode, the gate driving part 400 may receive the second vertical start signal PSTV. Further, the gate driving part 400 may sequentially output the gate signals along the forward direction or the reverse direction.

When the display panel 100 displays the horizontal stripe pattern image, the gate driving part 400 may receive the first vertical start signal STV, the second vertical start signal PSTV, the first clock signal CPV1, and the second clock signal CPV2.

Thus, the first shift register SR1 may receive the first vertical start signal STV and the n-th shift register SRn may receive the second vertical start signal PSTV.

According to a control of the timing control part 200, the odd-numbered shift registers SR1, SR3, . . . , SRn-1 may receive the first clock signal CPV1 having a predetermined period (e.g., two horizontal periods (2H)) during the early ½ frame period and might not receive the first clock signal CPV1 during the late ½ frame period.

In addition, the even-numbered shift registers SR2, SR4, . . . , SRn might not receive the second clock signal CPV2 during the early ½ frame period and may receive the second clock signal CPV2 having the predetermined period (e.g., two horizontal periods (2H)) and an opposite phase to the first clock signal CPV1 during the late ½ frame period.

When the display panel 100 displays the horizontal stripe pattern image, the shift registers SR1, SR2, . . . , SRn of the gate driving part 400 may be driven in the forward and reverse directions (e.g., bi-directionally) in response to the first and second vertical start signals STV and PSTV, respectively. In addition, during the early ½ frame period, the gate driving part 400 may output the odd-numbered gate signals along the forward direction and the reverse direction of the shift registers SR1, SR2, . . . , SRn. In addition, during the late ½ frame period, the gate driving part 400 may output the even-numbered gate signals along the forward direction and the reverse direction of the shift registers SR1, SR2, . . . , SRn.

According to the present exemplary embodiment, when the horizontal stripe pattern image is displayed on the display panel 100, the gate driving part 400 bi-directionally outputs the gate signals in response to the first and second vertical start signals STV and PSTV which are concurrently received. For example, the gate driving part 400 may alternately output the odd-numbered and even-numbered gate signals every ½ frame period in response to the first and second clock signals CPV1 and CPV2, respectively. The white and black image data of the horizontal pattern image may correspond to the odd-numbered and even-numbered gate signals, respectively. Therefore, the data driving part 300 may alternately output the white and black image data of the horizontal pattern image every ½ frame period. As a result, the operating frequency of the data driving part 300 may be decreased. Although, it is described that the white and black image data may correspond to odd-numbered and even-numbered gate signals, respectively as an example, the present invention is not limited thereto. For example, the black and white image data may correspond to odd-numbered and even-numbered gate signals, respectively.

Figure 4:
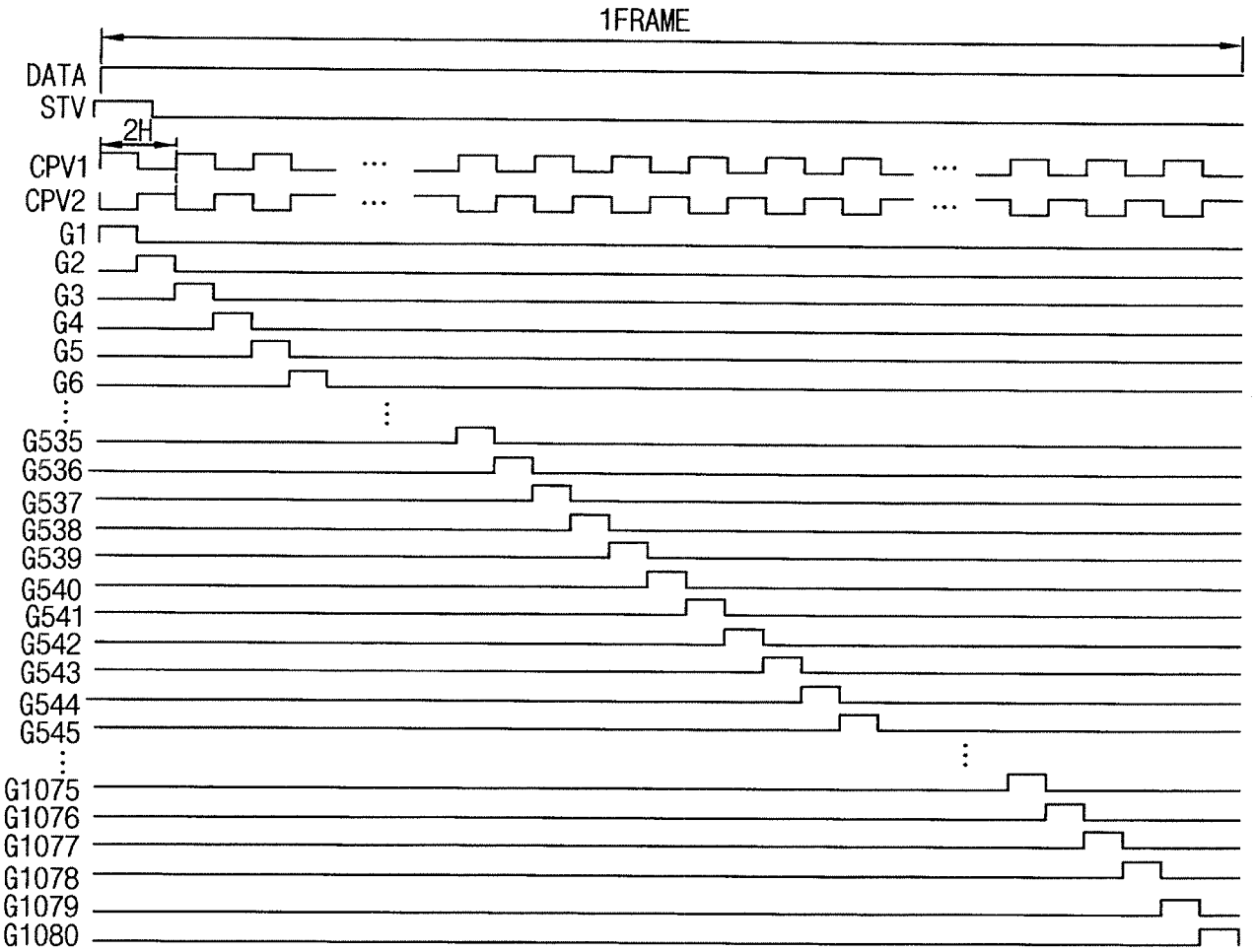
FIG. 4 is a waveform view illustrating a method of displaying a normal image through the display apparatus shown in FIG. 1, according to an exemplary embodiment of the present invention.

FIG. 4 is a waveform view illustrating a method of displaying a normal image through the display apparatus shown in FIG. 1 according to an exemplary embodiment of the present invention.

Referring to FIGS. 3 and 4, when the display panel 100 displays the normal image, the timing control part 200 provides the gate driving part 400 with the first or second vertical start signal STV or PSTV, the first clock signal CPV1, and the second clock signal CPV2. For example, in the forward direction mode of the shift registers SR1, SR2, . . . , SRn, the gate driving part 400 may receive the first vertical start signal STV and in the reverse direction mode of the shift registers SR1, SR2, . . . , SRn, the gate driving part 400 may receive the second vertical start signal PSTV.

The first clock signal CPV1 may be an alternating signal repeated on a cycle of horizontal periods (2H) during a frame (1FRAME). The second clock signal CPV2 may also be an alternating signal repeated on a cycle of horizontal periods (2H), but may have an opposite phase to the first clock signal CPV1.

The gate driving part 400 may sequentially output the gate signals in the forward direction of the shift registers SR1, SR2, . . . , SRn in response to the first vertical start signal STV. The odd-numbered shift registers SR1, SR3, . . . , SRn-1 of the gate driving part 400 may sequentially output the odd-numbered gate signals in synchronization with each clock pulse of the first clock signal CPV1. Referring back to FIG. 3, for example, the gate driving part 400 may sequentially output the odd-numbered gate signals G1, G3, . . . , G1079 in synchronization with each clock pulse of the first clock signal CPV1. In addition, the even-numbered shift registers SR2, SR4, . . . , SRn of the gate driving part 400 may sequentially output the even-numbered gate signals in synchronization with each clock pulse of the second clock signal CPV2. For example, the gate driving part 400 may sequentially output the even-numbered gate signals G2, G4, . . . , G1080 in synchronization with each clock pulse of the second clock signal CPV2.

Therefore, the gate driving part 400 may sequentially output first to 1080th gate signals G1, G2, . . . , G1080 in the forward direction.

Thus, the data driving part 300 may sequentially output the data signals of first to 1080th horizontal lines of the display panel 100 in synchronization with the first to 1080th gate signals of the gate driving part 400, respectively.

Although not shown in figures, when the gate driving part 400 receives the second vertical start signal PSTV which is the reverse direction control signal, the gate driving part 400 may sequentially output the 1080th to first gate signals G1080, G1079, . . . , G1 in the reverse direction. And thus, the data driving part 300 may sequentially output the data signals of the 1080th to first horizontal lines of the display panel 100 in synchronization with the 1080th to first gate signals outputted from the gate driving part 400.

Therefore, the display panel 100 may display the normal image.

Figure 5:
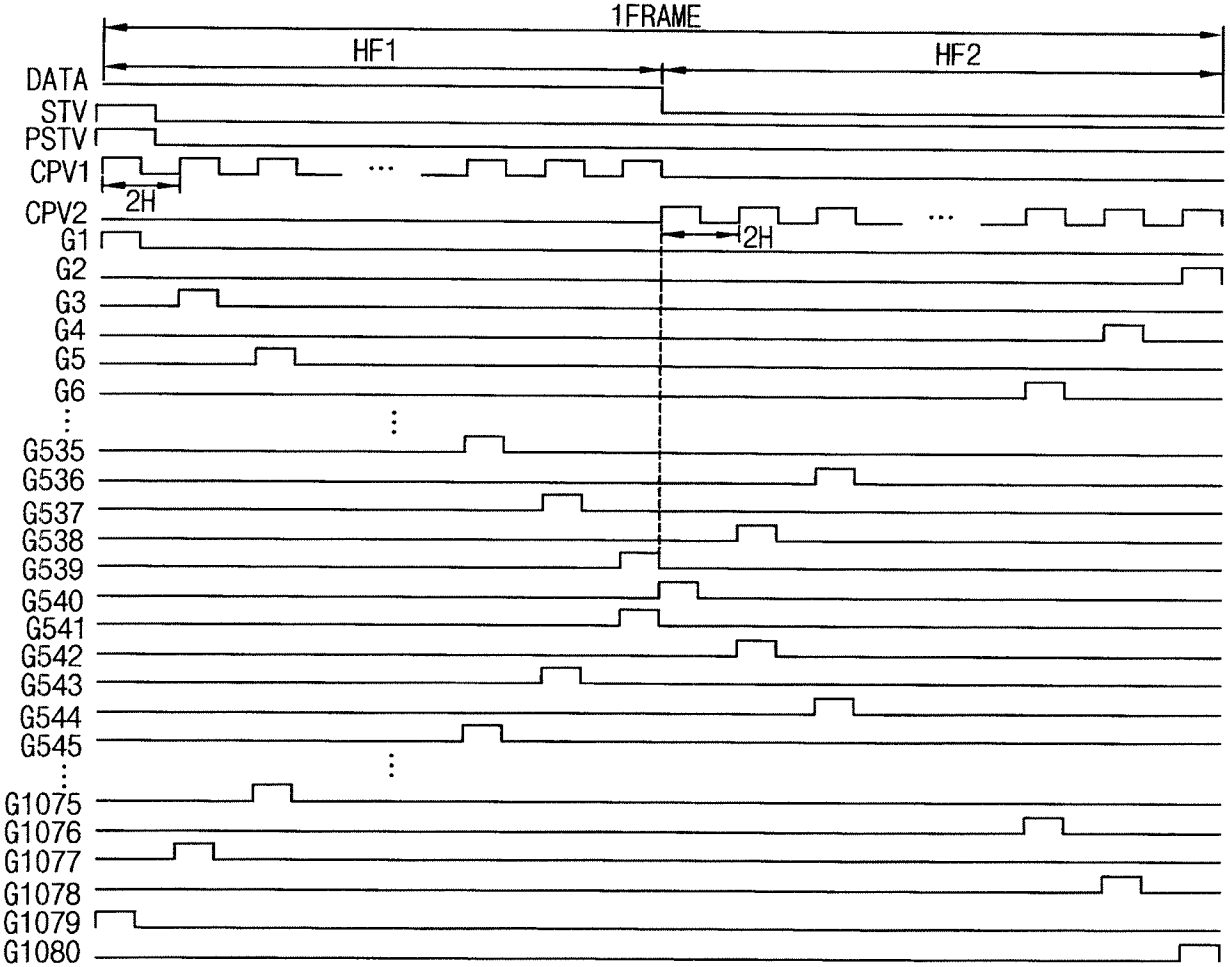
FIG. 5 is a waveform view illustrating a method of displaying a horizontal stripe pattern image through the display apparatus shown in FIG. 1, according to an exemplary embodiment of the present invention.
Figure 6A:
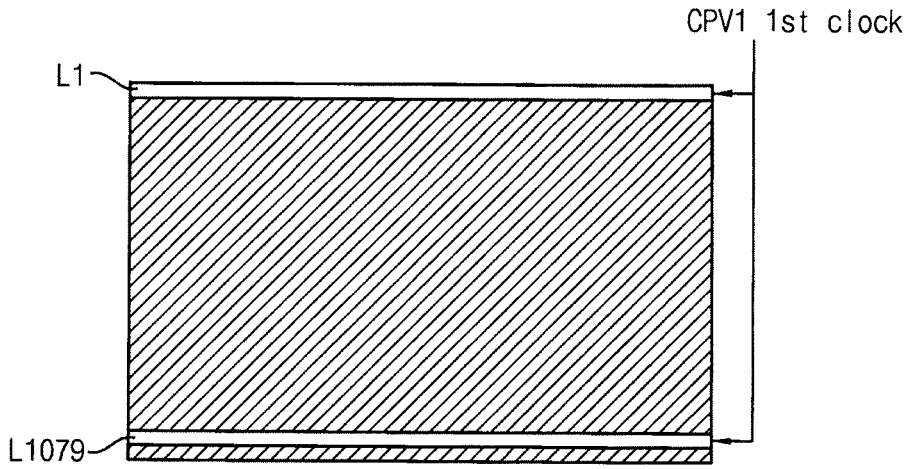
FIGS. 6A to 6F are diagrams illustrating a method of displaying a horizontal stripe pattern image through the display apparatus shown in FIG. 1, according to an exemplary embodiment of the present invention.
Figure 6B:
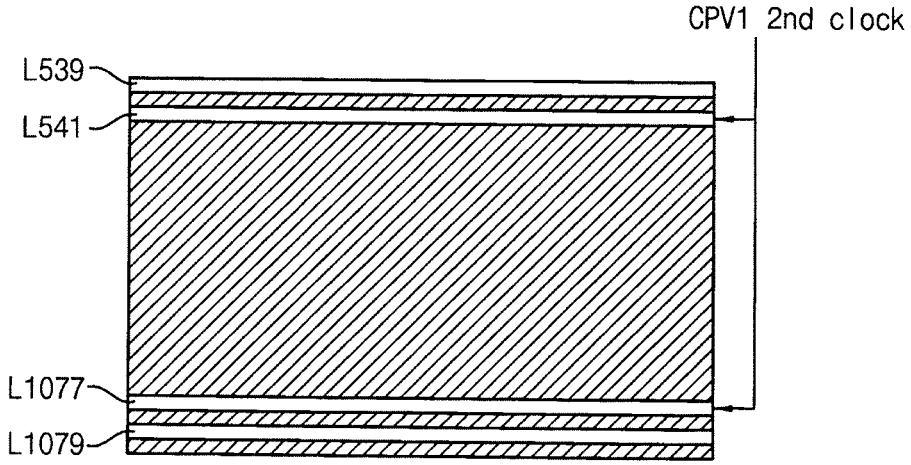
Figure 6C:
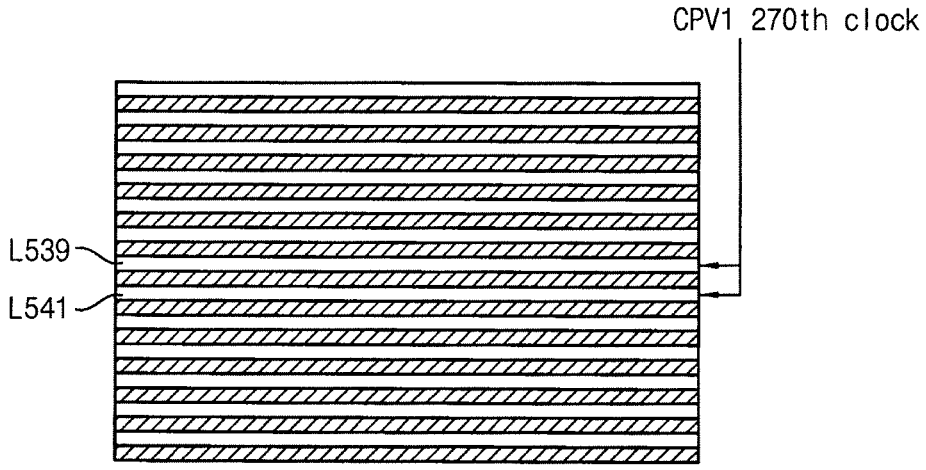
Figure 6D:
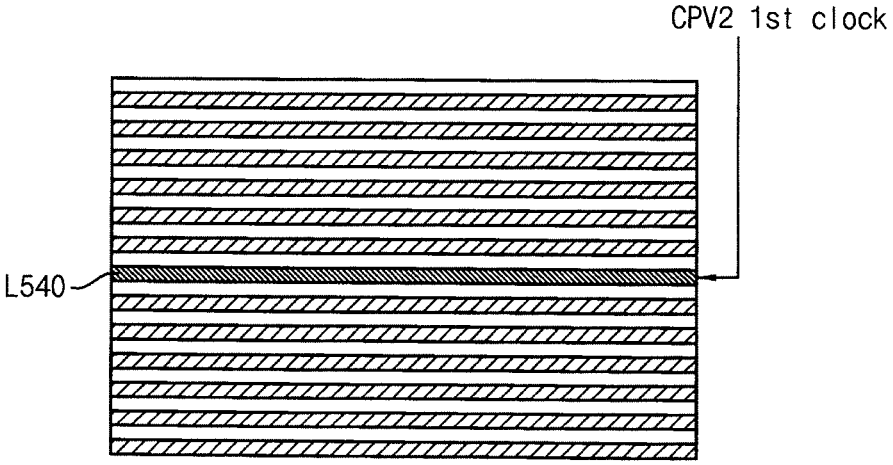
Figure 6E:
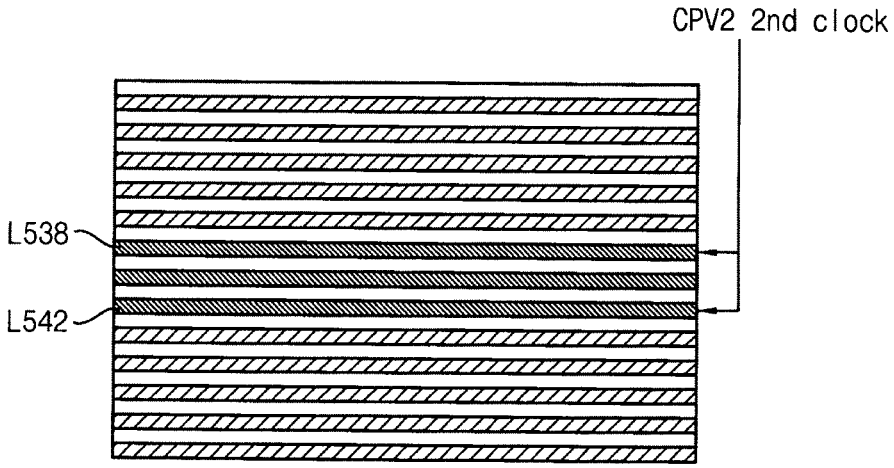
Figure 6F:
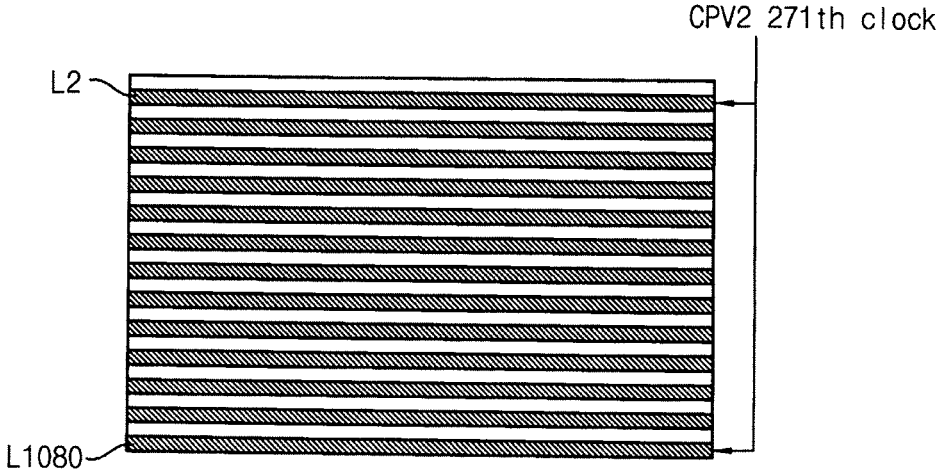

FIG. 5 is a waveform view illustrating a method of displaying a horizontal stripe pattern image through the display apparatus shown in FIG. 1, according to an exemplary embodiment of the present invention. FIGS. 6A to 6F are diagrams illustrating the method of displaying the horizontal stripe pattern image according to an exemplary embodiment of the present invention.

Referring to FIGS. 3 and 5, when the timing control part 200 receives image data of the horizontal stripe pattern image, the gate driving part 400 may receive the first vertical start signal STV, the second vertical start signal PSTV, the first clock signal CPV1, and the second clock signal CPV2.

The first and second vertical start signals STV and PSTV are concurrently applied to the first shift register SR1 and the n-th shift register SRn, in other words, the last shift register of the gate driving part 400.

The first clock signal CPV1 is applied to the odd-numbered shift registers SR1, SR3, . . . , SRn-1 of the gate driving part 400 during the early ½ frame period HF1 and is not applied to the odd-numbered shift registers SR1, SR3, . . . , SRn-1 of the gate driving part 400 during the late ½ frame period HF2. However, the second clock signal CPV2 is not applied to the even-numbered shift registers SR2, SR4, . . . , SRn during the early ½ frame period HF1 and then is applied to the even-numbered shift registers SR2, SR4, . . . , SRn during the late ½ frame period HF2.

The gate driving part 400 sequentially drives the shift registers SR1, . . . , SRn in the forward direction thereof in response to the first vertical start signal STV1 and sequentially drives the shift registers SR1, . . . , SRn in the reverse direction thereof in response to the second vertical start signal STV2 at the same time. In other words, the gate driving part 400 drives the shift registers SR1, . . . , SRn in the forward and second directions at the same time (e.g., bi-directionally).

During the early ½ frame period, the gate driving part 400 does not receive the second clock signal CPV2 so that the even-numbered gate signals is not outputted. However, the gate driving part 400 sequentially outputs the odd-numbered gate signals in synchronization with each clock pulse of the first clock signal CPV1. The odd-numbered shift registers of the gate driving part 400 sequentially output the odd-numbered gate signals in synchronization with each clock pulse of the first clock signal CPV1 along the forward and reverse directions of the shift registers SR1, SR2, . . . , SRn.

For example, as shown in FIG. 5, a first gate signal G1 in the forward direction of and a 1079th gate signal G1079 in the reverse direction may be outputted in synchronization with a first clock pulse of the first clock signal CPV1. A third gate signal G3 in the forward direction and a 1077th gate signal G1077 in the reverse direction may be outputted in synchronization with a second clock pulse of the first clock signal CPV1. A fifth gate signal G5 in the forward direction and a 1075th gate signal G1075 in the reverse direction may be outputted in synchronization with a third clock pulse of the first clock signal CPV1. As described above, a 539th gate signal G539 in the forward direction and a 541st gate signal G541 in the reverse direction may be outputted in synchronization with a 270th clock pulse of the first clock signal CPV1. Thus, during the early ½ frame period HF1, the gate driving part 400 may output the odd-numbered gate signals G1, G3, . . . , G1079 in synchronization with the first clock signal CPV1 along the forward and reverse directions of the shift registers SR1, . . . , SRn.

During the late ½ frame period HF2, the gate driving part 400 does not receive the first clock signal CPV1 so that the odd-numbered gate signals are not outputted. However, the gate driving part 400 sequentially outputs the even-numbered gate signals in synchronization with each clock pulse of the second clock signal CPV2. The even-numbered shift registers of the gate driving part 400 sequentially output the even-numbered gate signals in synchronization with each clock pulse of the second clock signal CPV2 along the forward and reverse directions of the shift registers SR1, SR2, . . . , SRn.

For example, as shown in FIG. 5, a 540th gate signal G540 in the forward direction may be outputted in synchronization with a first clock pulse of the second clock signal CPV2. A 542nd gate signal G542 in the forward direction and a 538th gate signal G538 in the reverse direction may be outputted in synchronization with a second clock pulse of the second clock signal CPV2. A 544th gate signal G544 in the forward direction and a 536th gate signal G536 in the reverse direction may be outputted in synchronization with a third clock pulse of the second clock signal CPV2. As described above, a 1080th gate signal G1080 in the forward direction and a second gate signal G2 in the reverse direction may be outputted in synchronization with a 271st clock pulse clock pulse of the second clock signal CPV2. Thus, during the late ½ frame period HF2, the gate driving part 400 may output the even-numbered gate signals G2, G4, . . . , G1080 in synchronization with the second clock signal CPV2 along the forward and reverse directions of the shift registers SR1, . . . , SRn.

The data driving part 300 output the data signals that correspond to the white image of the horizontal stripe pattern image during the early ½ frame period HF1 and output the data signals that correspond to the black image of the horizontal stripe pattern image during the late ½ frame period HF2.

Therefore, as shown in FIGS. 6A to 6F, the white image may be displayed on: the first and 1079th horizontal lines L1 and L1079 in synchronization with the first clock pulse of the first clock signal CPV1; the third and 1077th horizontal lines L3 and L1077 in synchronization with the second clock pulse of the first clock signal CPV1; the fifth and 1075th horizontal lines L5 and L1075 in synchronization with the third clock pulse of the first clock signal CPV1. As described above, the white image may be displayed on the 539th and 541st horizontal lines L539 and L541 in synchronization with the 270th clock pulse of the first clock signal CPV1. Therefore, during the early ½ frame period HF1, the white image may be sequentially displayed on the odd-numbered horizontal lines L1, L3, L5, . . . , L1079 of the display panel 100 in synchronization with the first clock signal CPV1.

In addition, the black image may be displayed on: the 540th horizontal line L540 in synchronization with the first clock pulse of the second clock signal CPV2; the 542nd and 538th horizontal lines L542 and L538 in synchronization with the second clock pulse of the second clock signal CPV2; the 544th and 536-th horizontal lines L544 and L536 in synchronization with the third clock pulse of the second clock signal CPV2. As described above, the black image may be displayed on the 1080th and second horizontal lines L1080 and L2 in synchronization with the 271st clock pulse of the second clock signal CPV2. Therefore, during the late ½ frame period HF2, the black image may be displayed on the even-numbered horizontal lines L2, L4, L6, . . . , L1080 of the display panel 100 in synchronization with the second clock signal CPV2. Thus, during the frame period, the white image and the black image may be alternately displayed every ½ frame period so that the horizontal stripe pattern image is displayed on the display area DA of the display panel 100.

According to an exemplary embodiment of the present invention, to display the horizontal stripe pattern image, the gate driving part 400 may sequentially drive the shift registers SR1, . . . , SRn in the forward direction in response to the first vertical start signal STV and may sequentially drive the shift registers SR1, . . . , SRn in the reverse direction in response to the second vertical start signal PSTV. Further, the gate driving part 400 may output the odd-numbered gate signals during the early ½ frame period in response to the first clock signal CPV1 and may output the even-numbered gate signals during the ½ frame period in response to the second clock signal CPV2. The white image and the black image are displayed on the odd-numbered horizontal lines and the even-numbered horizontal lines, respectively. Thus, the white image and the black image of the horizontal stripe pattern image may be alternatively outputted every ½ frame period and as a result, the operating frequency of the data driving part 300 may be decreased.

Figure 7A:
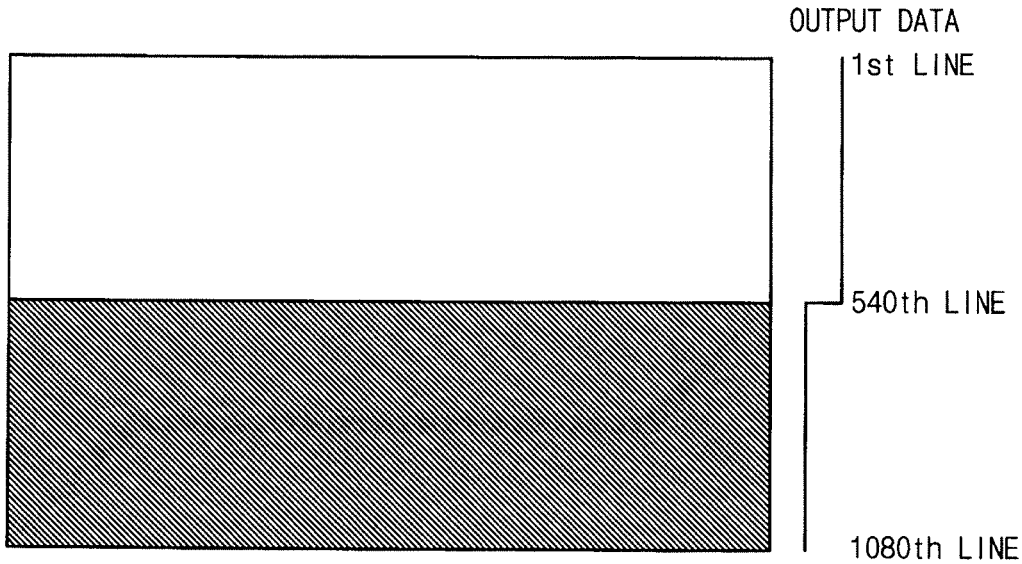
FIGS. 7A and 7B are diagrams illustrating an operation of a data driving part of the display apparatus shown in FIG. 1, according to an exemplary embodiment of the present invention and a comparative exemplary embodiment.
Figure 7B:
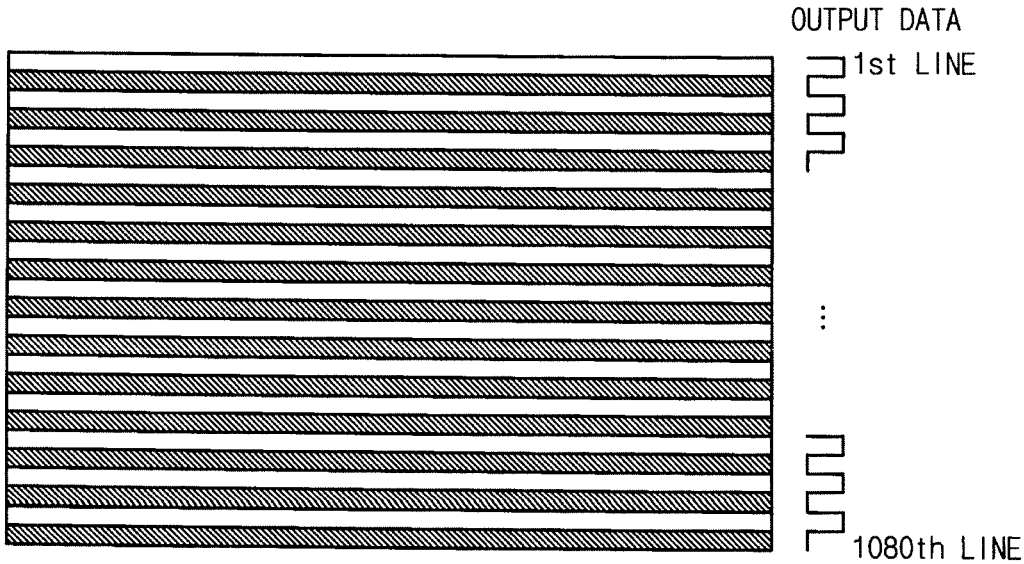

FIGS. 7A and 7B are diagrams illustrating an operation of the data driving part 300 according to an exemplary embodiment of the present invention and a comparative exemplary embodiment.

FIG. 7A is a diagram illustrating an operation of a data driving part according to an exemplary embodiment of the present invention. FIG. 7B is a diagram illustrating an operation of a data driving part according to a comparative exemplary embodiment. According to the comparative exemplary embodiment, the data driving part may be driven in synchronization with the gate driving part which may sequentially output a plurality of gate signals along a single direction, for example, the forward direction or the reverse direction.

Referring to FIG. 7A, the data driving part 300 according the exemplary embodiment of the present invention may output the data signal of the white image during the early ½ frame period of the frame and may output the data signal of the black image during the late ½ frame period so that the horizontal stripe pattern image may be displayed. Thus, the data driving part 300 of the exemplary embodiment may have an output signal (OUTPUT DATA) which swings by the ½ frame period. For example, the data driving part 300 of the exemplary embodiment of the present invention may be alternatively driven every ½ frame period and thus, the operating frequency thereof may be decreased.

Referring to FIG. 7B, the data driving part of the comparative exemplary embodiment may alternately output the data signals of the white image and the black image by a horizontal period (1H) so that the horizontal stripe pattern image may be displayed. Thus, the data driving part of the comparative exemplary embodiment may have an output signal (OUTPUT DATA) which swings by the horizontal period (1H).

The able below includes measured data illustrating surface temperatures of data driving parts (D-IC Chips) according to an exemplary embodiment of the present invention and a comparative exemplary embodiment.

TABLE

| | Comparative Exemplary Embodiment | Exemplary Embodiment |
|---|---|---|
| D-IC Chip | more than 125° C. | about 74.5° C. |

Referring to Table, a surface temperature of the data driving part according to the exemplary embodiment of the present invention is about 74.5° C. and a surface temperature of the data driving part according to the comparative exemplary embodiment is more than about 125° C. The surface temperature of the data driving part according to the exemplary embodiment of the present invention may be decreased by about 50% as compared with that of the comparative exemplary embodiment. Therefore, according to the exemplary embodiment of the present invention, life-shortening damage of the data driving part may be avoided by decreasing the temperature thereof.

According to an exemplary embodiment of the present invention, to display the horizontal stripe pattern, the output sequence of the gate signals may be modified to decrease the operating frequency of the data driving part. Thus, the temperature of the data driving part may be decreased so that life-shortening damage of the data driving part may be avoided.

The foregoing is illustrative of the present invention and is not to be construed as limiting thereof. Although a few exemplary embodiments of the present invention have been described, it will be understood that various modifications in form and details may be made therein without departing from the spirit and scope of the present invention. Accordingly, it may be understood that the all such modifications are intended to be included within the scope of the present invention as defined in the claims.

What is claimed is:

1. A method of driving a display panel, the method comprising:

displaying a first image on at least one odd-numbered horizontal line of the display panel along a first direction and a second direction during a first period of a frame period, wherein, in the first period of the frame period, gate signals are provided to the odd-numbered horizontal lines starting from a top of the display panel and proceeding downward in the first direction and gate signals are provided to the odd-numbered horizontal lines starting from a bottom of the display panel and proceeding upward in the second direction; and displaying a second image on at least one even-numbered horizontal line of the display panel along the first direction and the second direction during a second period of the frame period.

2. The method of claim 1, further comprising generating a first vertical start signal, a second vertical start signal, a first clock signal, and a second clock signal in response to a horizontal pattern image, wherein the first vertical start signal is a control signal for the first direction, wherein the second vertical start signal is a control signal for the second direction.

3. The method of claim 2, wherein the first clock signal is generated during the first period and not generated during the second period, and wherein the second clock signal is generated during the second period and not generated during the first period.

4. The method of claim 3, further comprising:

outputting a first gate signal that corresponds to a first odd-numbered horizontal line and a second gate signal that corresponds to a last odd-numbered horizontal line in response to the first clock signal during the first period; and outputting a third gate signal that corresponds to a first even-numbered horizontal line and a fourth that corresponds to a last even-numbered horizontal line in response to the second clock signal during the second period.

5. The method of claim 1, further comprising:

outputting a first data signal of the first image to a corresponding one of a plurality of data lines of the display panel during the first period; and outputting a second data signal of the second image to a corresponding one of the plurality of data lines of the display panel during the second period.

6. The method of claim 1, wherein the first period corresponds to a first half period of the frame period and the second period corresponds to a second half period of the frame period.

7. The method of claim 1, wherein the first and second images are a white and a black image, respectively.

8. A display apparatus, comprising:

a display panel comprising a plurality of horizontal lines; and a panel driving part configured to display a first image on at least one odd-numbered horizontal line of the display panel along a first direction and a second direction during a first part of a frame period and to display a second image on at least one even-numbered horizontal line of the display panel along the first direction and the second direction during a second part of the frame period, wherein, in the first part of the frame period, gate signals are provided to the odd-numbered horizontal lines starting from a top of the display panel and proceeding downward in the first direction and gate signals are provided to the odd-numbered horizontal lines starting from a bottom of the display panel and proceeding upward in the second direction.

9. The display apparatus of claim 8, wherein the panel driving part comprises:

a timing control part configured to generate a first vertical start signal, a second vertical start signal, a first clock signal, and a second clock signal; and a gate driving part configured to output first to n-th gate signals to first to n-th gate lines of the display panel, respectively, wherein the first vertical start signal controls the gate driving part to sequentially output the first to n-th gate signals in the first direction, wherein the second vertical start signal controls the gate driving part to sequentially output the first to n-th gate signals in the second direction, wherein the first clock signal controls at least one odd-numbered gate signal, and wherein the second clock signal controls at least one even-numbered gate signal.

10. The display apparatus of claim 9, wherein the timing control part controls an output of the first and second clock signals based on a pattern of the image.

11. The display apparatus of claim 10, wherein the pattern of the image is a horizontal pattern.

12. The display apparatus of claim 11, wherein the timing control part provides the gate driving part with the first clock signal and does not provide the gate driving part with the second clock signal during the first part of the frame period, and the timing control part provides the gate driving part with the second clock signal and does not provide the gate driving part with the first clock signal during the second part of the frame period.

13. The display apparatus of claim 11, wherein the timing control part comprises:

a clock generating part configured to generate the first and second clock signals; and a switching part configured to control the output of the first and second clock signals.

14. The display apparatus of claim 13, wherein the switching part outputs the first clock signal and does not output the second clock signal during the first part of the frame period, and the switching part outputs the second clock signal and does not output the first clock signal during the second part of the frame period.

15. The display apparatus of claim 9, wherein the timing control part concurrently outputs the first and second vertical start signals to the gate driving part.

16. The display apparatus of claim 9, wherein the panel driving part outputs a data signal of a white image to the display panel during the first part of the frame period, and outputs a data signal of a black image to the display panel during the second part of the frame period.

17. The display apparatus of claim 9, wherein the first clock signal has a phase opposite to the second clock signal, and each of the first and second clock signals is a periodic pulse signal having a predetermined period.

18. The display apparatus of claim 17, wherein the predetermined period is two horizontal periods.

19. The display apparatus of claim 9, wherein the gate driving part comprises first to n-th shift registers which respectively output the first to n-th gate signals to the first to n-th gate lines of the display panel.

20. The display apparatus of claim 19, wherein the first vertical start signal is applied to the first shift register and the second vertical start signal is applied to the n-th shift register.

21. The display apparatus of claim 19, wherein the first clock signal controls at least one odd-numbered shift register and the second clock signal controls at least one even-numbered shift register.

* * * * *